United States Patent [19]

Willams

[11] 4,226,371

[45] Oct. 7, 1980

[54] INERT GRINDING AND DIRECT FIRING IN COAL BURNING SYSTEMS

[76] Inventor: Robert M. Willams, 16 La Hacienda, Ladue, Mo. 63124

[21] Appl. No.: 27,742

[22] Filed: Apr. 6, 1979

[51] Int. Cl.[3] ..... B02C 21/00

[52] U.S. Cl. ..... 241/31; 241/48; 241/79.1

[58] Field of Search ..... 44/1 B, 2; 34/72; 241/47, 48, 57, 62, 79.1, 24; 60/682-684

[56] References Cited

U.S. PATENT DOCUMENTS 1,783,358 12/1930 Crites et al. ..... 241/48 X 3,477,650 11/1969 Williams ..... 241/47

3,610,594 10/1971 Williams ..... 241/48 X

*Primary Examiner*—Mark Rosenbaum

*Attorney, Agent, or Firm*—Gravely, Lieder & Woodruff

[57] ABSTRACT

A system in which coal is ground and transported in an inert atmosphere to a place of burning which may be a rotary kiln or a furnace, and in which system the coal being ground is used as the medium to produce the drying and inerting while the transporting media is the air brought in from outside the system and treated in a heating unit to consume part of the normal oxygen so it is rendered inert by the time it circulates in the system as the transporting media.

6 Claims, 1 Drawing Figure

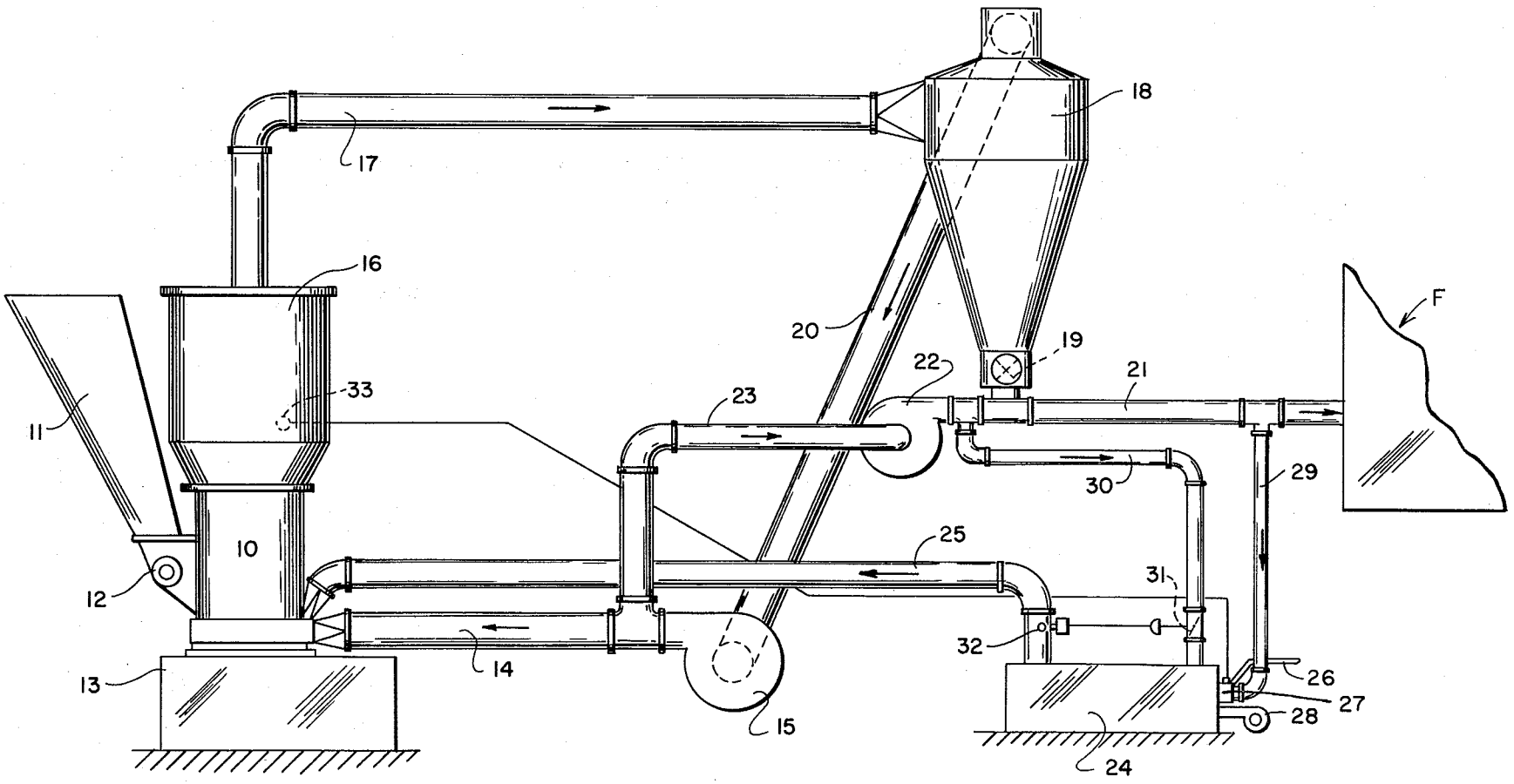
F
29
26
27
28
18
21
30
31
24
19
32
22
25
20
15
23
14
17
16
33
10
12
13
11

INERT GRINDING AND DIRECT FIRING IN COAL BURNING SYSTEMS

BACKGROUND OF THE INVENTION

It is known that the prior art includes semidirect coal firing in a system which does not have an inert atmosphere and is therefore, vulnerable to fire and explosion. Such prior art systems are normally built at great expense to sustain internal pressures of significant magnitude to contain all by the most violent explosion. In these prior art systems the ambient air is conducted through a heater which merely heats the air without burning out some of the oxygen. The hot air at normal 21 percent oxygen is introduced into the coal grinder where it is intended to dry the moisture and function as the transporting media for the ground coal. After transporting the ground coal to a separator, the air is returned to the grinder, but part of the returning air by passes the grinder and is employed to move the separated ground coal into the furnace where it is consumed.

While the foregoing system cannot be classified as an inert atmosphere system, I have disclosed in my prior U.S. Pat. No. 3,477,650 of Nov. 11, 1969 apparatus to provide an inert atmosphere in a material reducing mill by utilizing the inert air in the system to mix with fresh air in a furnace where the mixture is used to support combustion to the extent that the flue gas is inerted and at a temperature suitable for drying the material during its reduction and exit from the reducing mill. Any dust fractions moved with the drying and inert media are removed before such media is admitted to the furnace.

An early system of using heated air for drying as well as transporting pulverized material is disclosed by Crites et al in U.S. Pat. No. 1,783,358 of Dec. 2, 1930, but the system made no attempt to reduce the oxygen level to establish an inert atmosphere, nor did it employ the pulverized material as the fuel for producing the drying heat.

BRIEF DESCRIPTION OF THE INVENTION

The present invention is directed to improvement in the grinding and direct firing of coal in coal burning systems.

Important objects of this invention are to inhibit the fire and explosion hazards in the foregoing systems, to create inert atmospheric conditions so the apparatus does not need to be built to sustain abnormally high internal pressure, to employ the ground coal as the fuel source for drying and for inerting the atmosphere, and to means for effecting control over the grinding rate and the drying temperature in the system.

The invention is embodied in a system which combines grinding means for conditioning the coal or other fuel material so it may be transported efficiently in a gaseous medium, primary means for propelling the gaseous medium through the grinding means and to a place where it can be separated to allow the gaseous medium to be returned for reuse, secondary propelling means for using a portion of the gaseous medium to transport the separated out ground material to a furnace or kiln for firing the same, a heater which uses the ground material as its primary fuel to produce heat and to inert the heated gaseous medium, and means to supply the heater with the gaseous medium and ground material in quantities not necessarily required by the furnace or kiln.

BRIEF DESCRIPTION OF THE DRAWING

The present embodiment of this invention is illustrated in the single drawing view which is a schematic arrangement of the several components making up an operative system.

DETAILED DESCRIPTION OF THE EMBODIMENT

The presently preferred embodiment of the present apparatus is shown schematically in the single view of the drawing wherein a pulverizing mill 10 is provided with a bunker 11 which supplies the fuel material, which may be coal, to the mill through a rotary gate assembly 12. The mill 10 is provided with a common type of variable speed drive operatively mounted in the base housing 13. The output of the mill 10 is forced by a flow of inert hot gaseous medium supplied through conduit 14 from the primary blower or fan 15. The inert hot gaseous medium provides the transportation for the mill output, and the flow passes through a normal type of separator 16 which permits the desired small size particles to pass through and returns the larger particles to the mill for further reduction. The output from the separator 16 moves along in conduit 17 to a standard type cyclone separator 18 where the fuel particles are collected at the rotary valve 19. The gaseous transporting medium leaves the cyclone 18 through conduit 20 and returns to the primary fan 15 to complete a circulating system which effectively transports the ground fuel to the rotary valve 19 where it can be released into conduit 21 for delivery to the ground fuel consuming unit shown in fragmentary outline at 7.

The present apparatus utilizes a portion of the inert gaseous transporting medium circulated by the primary fan 15 through the action of a secondary fan 22 which has an inlet conduit 23 connected into the conduit 14 on the outlet side of the primary fan 15. The outlet of the secondary fan 22 is connected into conduit 21 at the rotary valve 19 so that the inert gaseous transporting medium moved by the secondary fan 22 effectively transports the ground fuel material into the consuming unit 7.

The present apparatus operates to maintain the inert condition of the gaseous transporting medium through the use of the heater 24 which has its hot gaseous outlet conduit 25 connected in such a way that the inert hot gaseous produced by the heater 24 is delivered to the mill 10 where it performs the inerting and fuel drying function. The heater 24 at the time of start up of the apparatus is provided with a suitable auxilary fuel brought in by conduit 26 to the burner 27. Combustion air is provided through the ambient air blower 28 in order to initiate the production of hot gaseous medium. Once the apparatus has reached its operating condition the auxilary fuel 26 is terminated or substantially reduced, and the ambient air blower 28 is likewise shut down, or substantially reduced. The heater 24 thereafter operates on a fuel supplied through conduit 29 extracted from the conduit 21 so that a portion of the ground fuel material supplied to the consuming unit 7 is delivered to the heater 24. Tempering air is supplied to the heater 24 through conduit 30 which is connected between the secondary blower 22 and the rotary valve 19, thereby utilizing the inert gaseous transporting medium free of the ground fuel material. A temperature balance between the gaseous transporting medium supplied through conduit 30 and the ambient air supplied by blower 28 is obtained through a damper 31 in the conduit 30 which is modulated by a temperature responsive element 32 in the heater outlet conduit 25. The modulation is intended to limit the temperature of the inert hot gaseous medium in the conduit 25. An additional control over the operation of the burner 27 is obtained by having a temperature sensor 33 mounted in the separator 16 at the delivery side of the mill 10 for the purpose of modulating the burner 27 so as to control the temperature at the separator 16.

An example of the utility of the present apparatus is found in the following disclosure. It is assumed that the consuming unit requires a supply of ground fuel material at the rate of 22,640 pounds per hour. This is achieved by operating the mill 10 so that its output to conduit 17 receives the ground fuel material and the gaseous transporting medium at the rate of 15,500 SCFM and at approximately 190° F. That amount of ground material and gaseous medium reaches the cyclone separator 18 where the ground fuel material is collected at the rotary valve 19, while the 15,500 SCFM gaseous transporting medium flows through conduit 20 to the primary fan 15. Since a portion of the gaseous medium delivered from the primary fan 15 is siphoned off through conduit 23 by the secondary fan 22, the apparatus is conditioned to permit the conduit 14 to deliver 10,500 SCFM at 900° F. and containing 14% oxygen, or less, 5,000 SCFM of the gaseous transporting medium passes through conduit 23 where it is proportioned so that approximately 3,000 SCFM of the gaseous transporting medium flows through the conduit 30 to the heater 24 and the remaining 2,000 SCFM of gaseous transporting medium flows through conduit 21 to transport approximately 23,000 pounds per hour of ground fuel material. Again it should be understood that conduit 29 receives approximately 357 pounds per hour of ground fuel material along with the recycled gaseous transporting medium. The heater 24 is operated at a level to produce approximately 5,000 SCFM of inert hot gaseous medium through conduit 25 to the mill 10. The total flow in conduits 14 and 25 makes up the required volume of gaseous medium flowing through the mill 10 and circulating through conduits 17 and 20.

The apparatus is operable with an inert gaseous transporting medium for effectively moving a substantial tonage per hour of ground fuel material into the consuming unit with only a small portion of the gaseous transporting medium needed for that purpose. This is a distinct advantage since the present apparatus does not operate in such a way that the consuming unit is supplied with an excess of gaseous medium. The apparatus has important advantages in that it is easily operated at less than the normal 21% oxygen whereby fire and explosion dangers, particularly at the mill 10, are avoided. The fire hazard is substantially overcome due to the lack of sufficient oxygen to support combustion, and the absence of combustion possibilities removes the chance of explosion. The result of these advantages is that the various components in making up the apparatus of this invention can be constructed to withstand normal temperatures and loads rather than to require a design capable of withstanding pressures well above atmospheric, such as the requirement to design for pressures of up to 50 psi. A considerable construction cost saving is achieved with apparatus of the character above described.

What is claimed is:

1. Apparatus for grinding a fuel material in an inert atmosphere and transporting the ground fuel material to fire a consuming unit, said apparatus comprising: grinding means for reducing the fuel material to a transportable and combustible size; primary propelling means connected to said grinding means for moving a gaseous transporting medium through said grinding means; separator means connected between said grinding means and said primary propelling means for separating the ground fuel material from the gaseous transporting medium and returning the gaseous transporting medium to said primary propelling means; secondary propelling means connected between said primary propelling means and said grinding means and a consuming unit, said connection between said secondary propelling means and consuming unit having an inlet for receiving ground fuel material from said separator means for movement by the gaseous transporting medium to the consuming unit; inert hot gas producing means having an outlet connected to said grinding means; conduit means connecting said inert hot gas producing means with said connection between said secondary propelling means and the consuming unit for supplying inert gaseous transporting medium and ground fuel material to be used in said inert hot gas producing means.

2. The apparatus set forth in claim 1, wherein said conduit means includes a first conduit for conducting inert gaseous medium to said inert hot gas producing means, and a second conduit for conducting ground fuel material to said inert hot gas producing means.

3. The apparatus set forth in claim 1, wherein said secondary propelling means is operative to deliver inert gaseous transporting medium with ground fuel material to the consuming unit, and ambient air supply means for the apparatus is connected into said inert hot gas producing means for supplying make up air substantially equal to the inert gaseous transporting medium delivered to the consuming unit.

4. The apparatus set forth in claim 1, wherein said secondary propelling means removes gaseous medium in advance of reaching said grinding means and supplies part of the gaseous medium removed back to said inert hot gas producing means, whereby the apparatus retains an inert atmosphere.

5. Apparatus for grinding a fuel material in an inert atmosphere and for transporting the ground fuel material to fire a consuming unit, said apparatus comprising: grinding means having an inlet for the fuel material and an outlet for the fuel material reduced to a transportable and combustible size; primary gaseous medium propelling means having an outlet conduit connected to said grinding means and an inlet; separator means connected between said grinding means outlet and said primary propelling means inlet for returning the gaseous transporting medium to said primary propelling means substantially free of ground fuel material; said separator means having an outlet for the ground fuel material; conduit means connecting said separator means outlet to a consuming unit; secondary propelling means having an inlet connected to said primary propelling means outlet conduit and having an outlet conduit connected to said conduit means for delivering inert gaseous medium to transport the ground fuel material from said separator means outlet to the consuming unit; inert hot gaseous medium producing means having an outlet for delivering the inert hot gaseous medium to said grinding means for drying and transporting the ground fuel material; first conduit connection between said secondary propelling means outlet and said inert hot gaseous medium producing means; and second conduit connection between said conduit means and said inert hot gaseous medium producing means, said first and second conduit means supplying gaseous medium and ground fuel material to said inert hot gaseous medium producing means for sustaining inert atmosphere in said apparatus.

6. Apparatus for grinding fuel material in an inert atmosphere and transporting the ground material to fire a consuming unit, comprising in combination: grinding means for conditioning the fuel material to a state capable of being transported by a gaseous medium; gaseous medium propelling means having an inlet and an outlet, said outlet being connected into said grinding means; separator means having an inlet connected to said grinding means and spaced apart outlets, one of said outlets being connected to said inlet for said gaseous medium propelling means; valve means operably mounted in said other separator outlet; gaseous medium heating means having an inlet for ambient air and an outlet for heated and inerted gaseous medium, said outlet being connected into said grinding means; conduit means connecting said other separator means outlet to a consuming unit; gaseous medium moving means having an inlet connected into said gaseous medium propelling means at said outlet and an outlet connected to said conduit means for utilizing the gaseous medium to move ground fuel material into the consuming unit from said other separator outlet passed said valve means; first means connected between said moving outlet and said gaseous medium heating means; and second means connected between said conduit means and said gaseous medium heating means; said first means recycling gaseous medium and said second means supplying ground fuel material to said gaseous medium heating means.

* * * * *